US008016506B2

(12) United States Patent
Adamberry

(10) Patent No.: US 8,016,506 B2
(45) Date of Patent: Sep. 13, 2011

(54) MAP PEN

(76) Inventor: Robert Adamberry, Aberdeen (CN)

( * ) Notice: Subject to any disclaimer, the term of this patent is extended or adjusted under 35 U.S.C. 154(b) by 457 days.

(21) Appl. No.: 12/284,129

(22) Filed: Sep. 17, 2008

(65) Prior Publication Data

US 2009/0080965 A1 Mar. 26, 2009

(30) Foreign Application Priority Data

Sep. 21, 2007 (HK) ..... 07110283.8
Jul. 9, 2008 (HK) ..... 08107539.5

(51) Int. Cl.
*B43K 29/00* (2006.01)

(52) U.S. Cl. ..... 401/195; 401/52
(58) Field of Classification Search ..... 401/29, 401/34, 35, 52, 195
See application file for complete search history.

(56) References Cited

U.S. PATENT DOCUMENTS

| | | | | |
|---|---|---|---|---|
| 1,561,725 | A * | 11/1925 | Kerley | 40/334 |
| 1,769,321 | A * | 7/1930 | Toth | 242/379 |
| 2,111,362 | A | 3/1938 | Fisher | |
| 2,301,364 | A * | 11/1942 | Bruck et al. | 401/52 |
| 2,508,372 | A * | 5/1950 | Carlson | 242/379.2 |
| 2,620,143 | A | 12/1952 | Armelin | |
| 4,030,842 | A | 6/1977 | White et al. | |
| D297,649 | S | 9/1988 | Schiffner | |
| 4,787,161 | A | 11/1988 | Feng | |
| 4,872,775 | A | 10/1989 | Chang | |
| 4,963,048 | A | 10/1990 | Thomas et al. | |
| D401,967 | S | 12/1998 | Tam | |
| 6,135,661 | A | 10/2000 | Houser | |
| 6,905,275 | B1 | 6/2005 | Del Valle | |

* cited by examiner

*Primary Examiner* — David Walczak
(74) *Attorney, Agent, or Firm* — Alix, Yale & Ristas, LLP

(57) ABSTRACT

An improved map pen comprises a fold up map or a stack of multiple sheets. A cocked flap or a sliding type knob or geared stopping mechanism is employed for holding the pulled-out map in any pulled-out position. The map pen is equipped with an additional pen mounted to the outside scroll end. A mini compass is mounted on top of map pen top button.

16 Claims, 18 Drawing Sheets

MAP PEN

FIELD OF THE INVENTION

This disclosure relates to implements for writing or drawing, particularly to combinations of writing implements with measuring, computing or indicating devices.

BACKGROUND

Combinations of writing implements with other articles are very common. An early one is a pencil with an eraser in one end. In providing such, it is very convenient for anyone who must often revise what is recorded by the pencil. A second famous one is a pen with lighting device. In doing so, anyone can take a note in the dark. Nowadays, since the tourist industry is adopted by all countries, combinations of writing implements with maps (as so called map pen) is a very common article which acts as an advertisement and a souvenir.

As a prior art device, the so called map pen (produced by the inventor, formerly called "Message Scroll Pen or Banner Pen") has been sold widely in the world for years. It is a ball pen and, in its stem, a rolled map (or any advertisement drawing) can be pulled out. But comments from the users are as follows:

1. The size of the map is too small.
2. Once the map is pulled out, the user must continuously pull it in position, otherwise the map/sheet will be drawn back by the spring inside.
3. Once the map is pulled out, the user found that he can not use the same pen for marking on the map/sheet.
4. Even if the map is marked by another pen at both the start point and the destination point, and a line is drawn therebetween, say 45 degrees north-east, the user still lacks of a compass for indicating the right direction.

SUMMARY

An object is to provide a map pen which addresses one or all of the above mentioned shortcomings. That is, the map pen has at least twice the map size of the prior device without adding the pulling-out length; the map pen has a holding mechanism used for optionally keeping the pulled-out map in position; the map pen is now equipped with an additional pen particularly for the purpose of marking the pulled-out map; the map pen is now equipped with an mini compass for indicating to the user which way to go.

Briefly stated, a fold up map or a stack of maps is employed in place of the original single sheet map. A kiss-cut flap, a sliding type of stopping mechanism, or a geared stopping mechanism is employed for holding the pulled-out map at any pulled-out position. An additional pen is equipped in outside scroll end. A mini compass is equipped on top of this map pen top. Furthermore the map sheets can also be perforated or half-cut so tear-away coupons can be used in exchange for advertised goods and services.

DETAILED DESCRIPTION OF THE EMBODIMENTS

Figure 1:
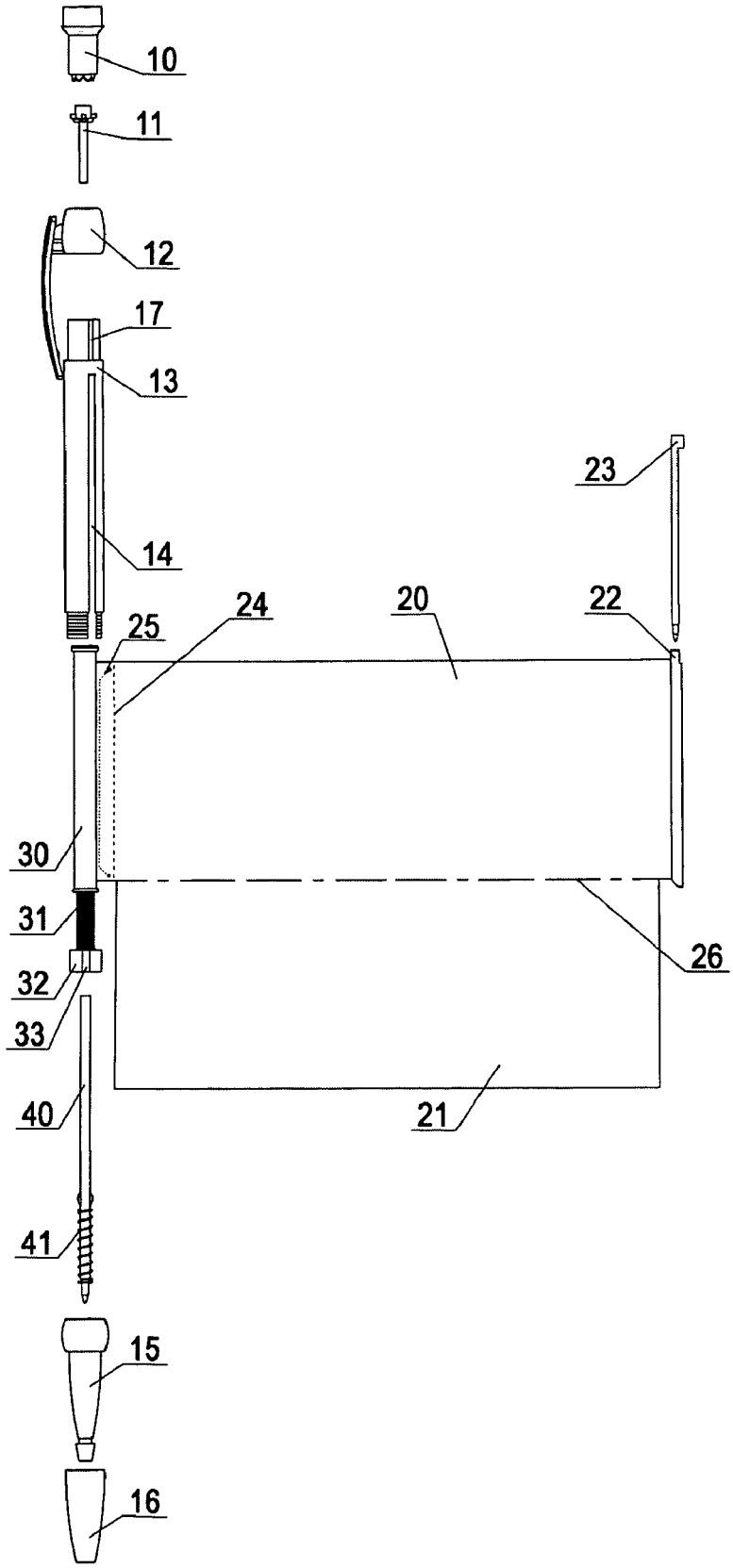
FIG. 1 is an exploded view of a first embodiment for showing components used except for the stopping mechanism.
Figure 5:
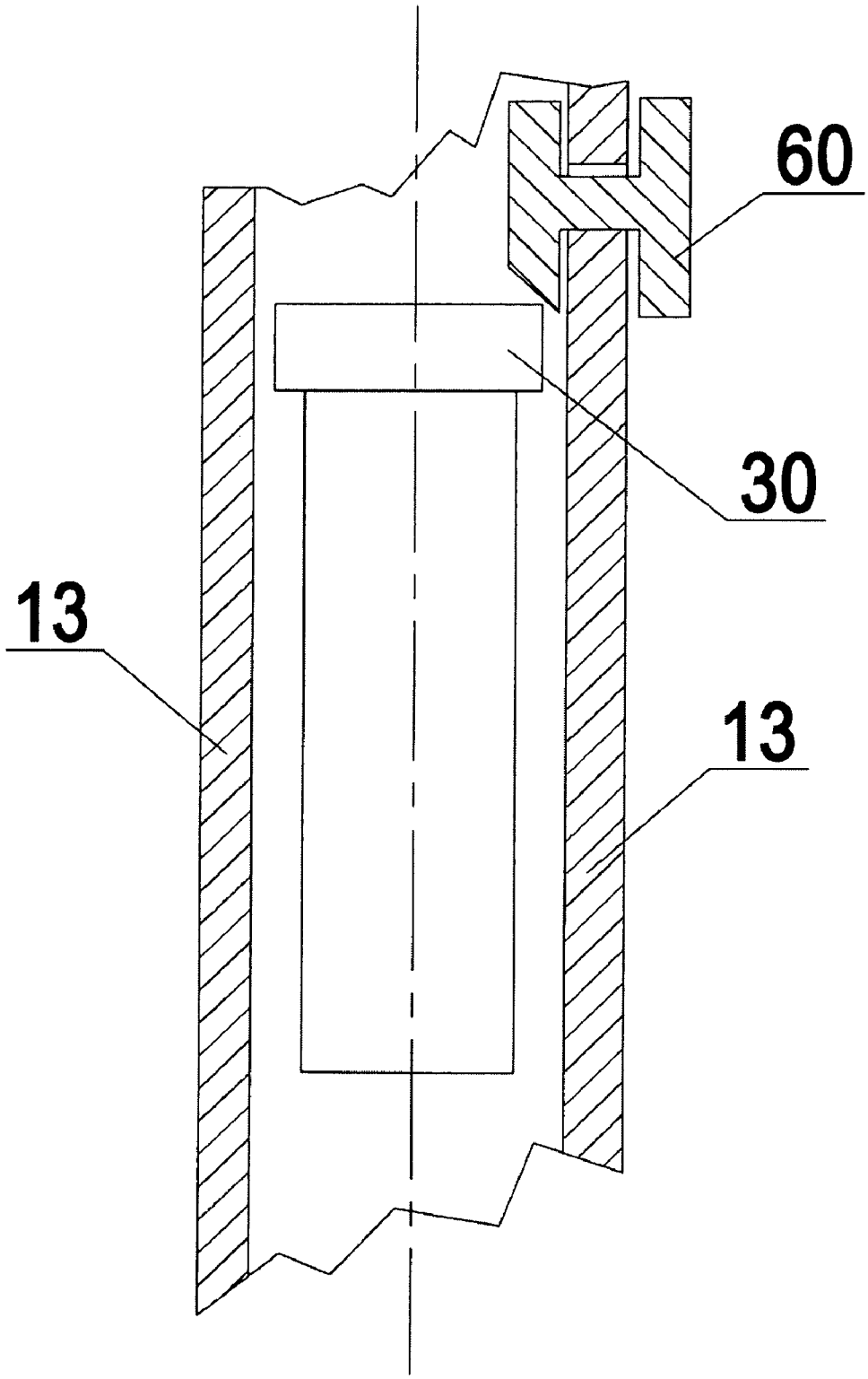
FIG. 5 is a sectional view showing how another optional stopping mechanism works.

With reference to FIG. 1, an exploded view of the map pen shows all substantially components used except for the stopping mechanism of FIG. 5. The top button 10, similar to a conventional ball pen, includes a plunger with a cup top and a geared base. A mini compass (see FIG. 6) is equipped in the top of this top button 10. A turning shaft 11 with a geared top is similar to conventional ball pen. A cap ring 12 with an integral clip is similar to a conventional ball pen. The outer housing barrel 13 with a thread is also similar to the prior art "Message Scroll Pen". The barrel 13 includes a slit 14 of both the prior art and these inventive pens. Base cap 15 and silicon grip 16 are components of a conventional ball pen.

20 designates a map of a first embodiment. Since in this embodiment, the map is fold-up, the map size is essentially doubled when it is pulled out and unfolded. The total map area is now equal to the area of map 20 and area 21. So the map can be printed in a larger scale than the noted prior art. The folding line is designated 26. Since the sheet for the map is now thinner than the prior art (if the barrel diameter remains unchanged), an improved high-strength plastic film should be used. An outside scroll end is used in both the prior art and in this embodiment.

An additional pen 23 is installed in the tube-shaped scroll end 22 for marking the map 20, 21. The end of the additional pen 23 can have a molded end 80 specifically designed for use as a PDA personal computer device pointer and stylus. Therefore this will further enhance the usefulness of the additional pen 23 as it can contain both an ink pen at one end and a PDA stick at the other end. The additional pen 23 can therefore be used on both traditional paper platforms when using the ink pen, as well as used on contemporary touch-screen based hardware and media when using the molded PDA stick end.

An inner scroll end 30 in the form of centre tube is used in both the prior art and this embodiment. A centre tube spring 31 is used in both the prior art and this embodiment. A locking nipple 32 is employed for spring tension. A groove 33 on the locking nipple enhances spring tension. These two components are also used in both the prior art and this embodiment. A pen refill 40 is also used in both the prior art and this embodiment. A pen refill spring 41 is used in both the prior art and this embodiment.

Figure 2:
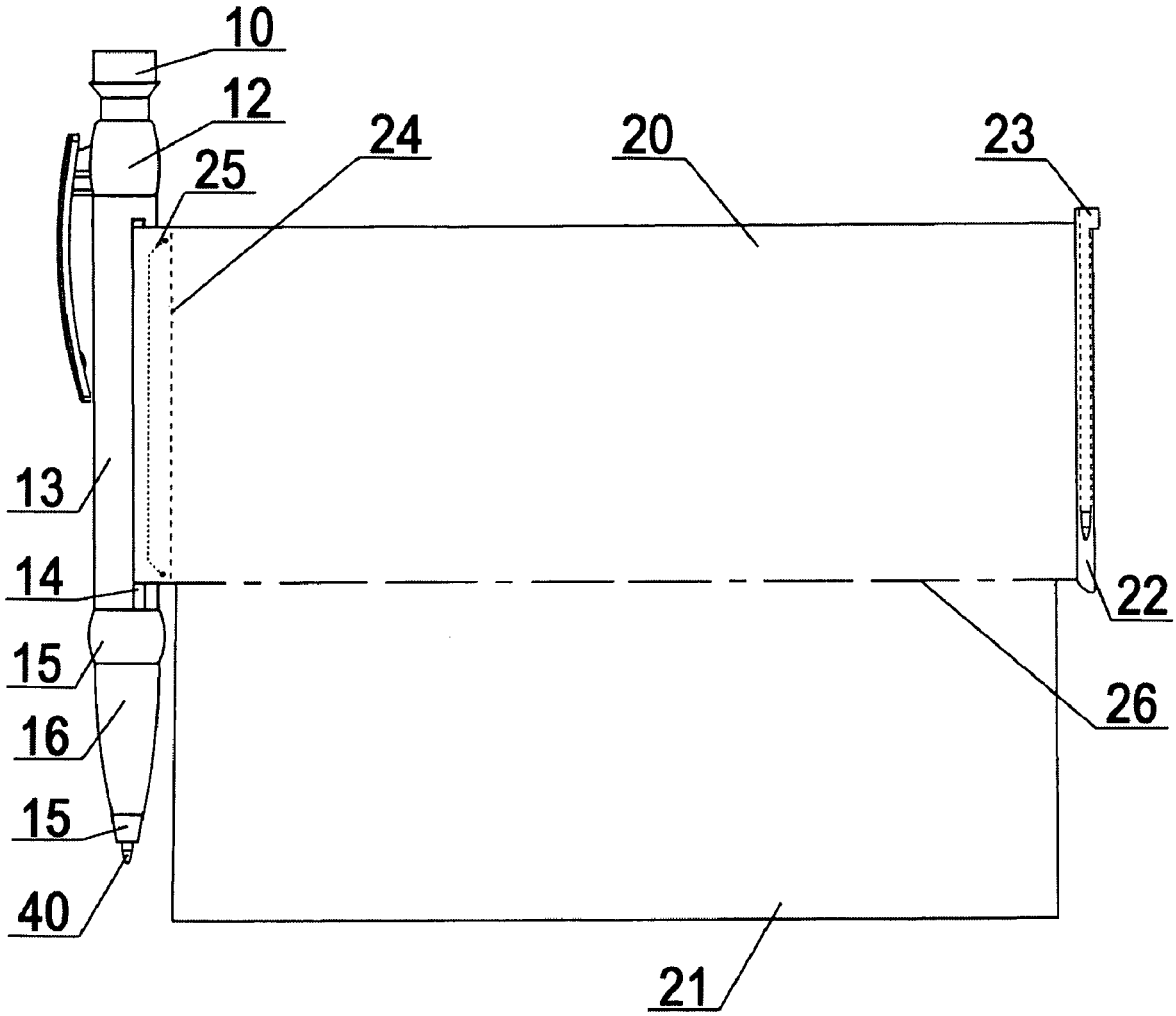
FIG. 2 is a view showing the map of the first embodiment in a pulled-out and un-folded configuration.
Figure 3:
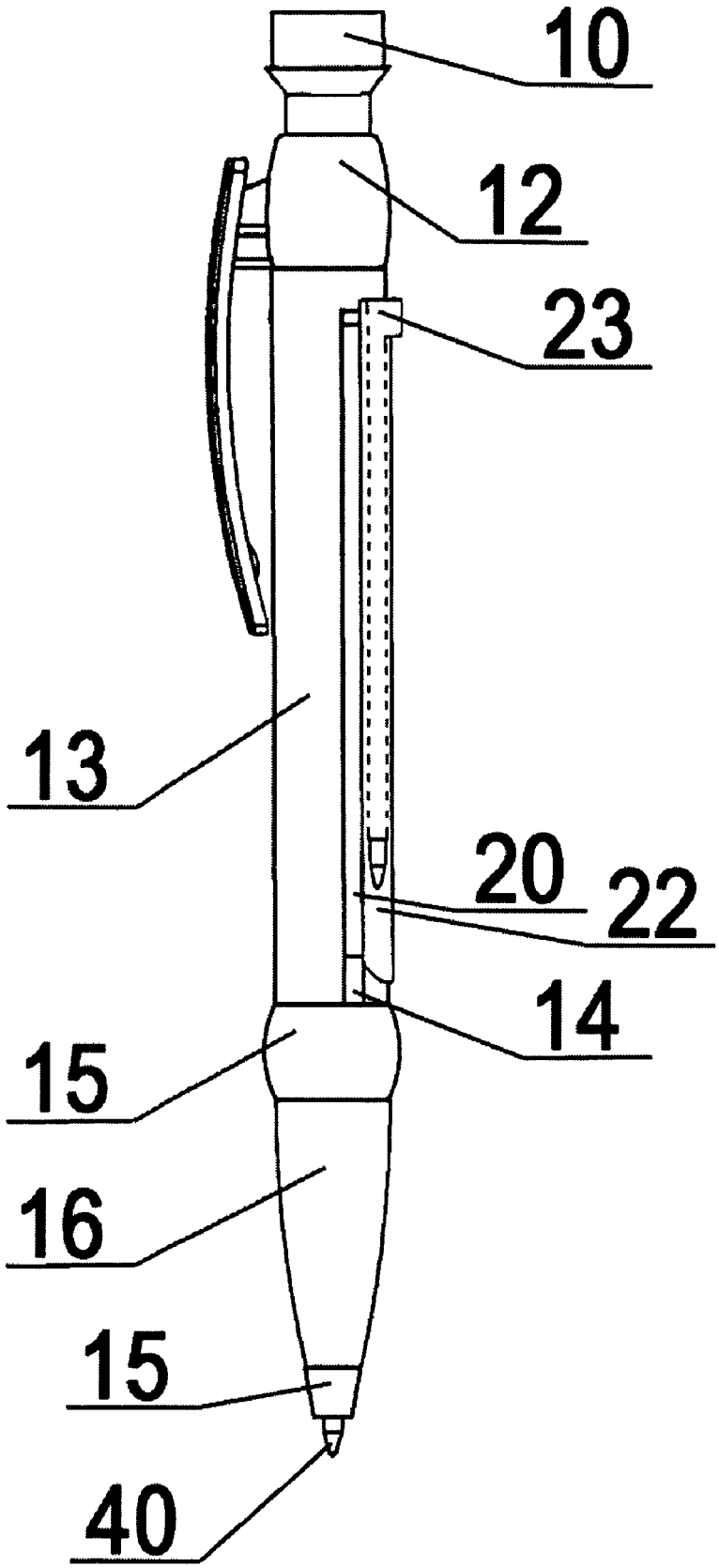
FIG. 3 is a view showing the map of FIG. 1 is drawn back into the stem by the conventional spring.

FIGS. 2 and 3 are drawings showing the outside views of the map pen of this first embodiment, when the map is pulled out and when the map is drawn-back, respectively.

Figure 4:
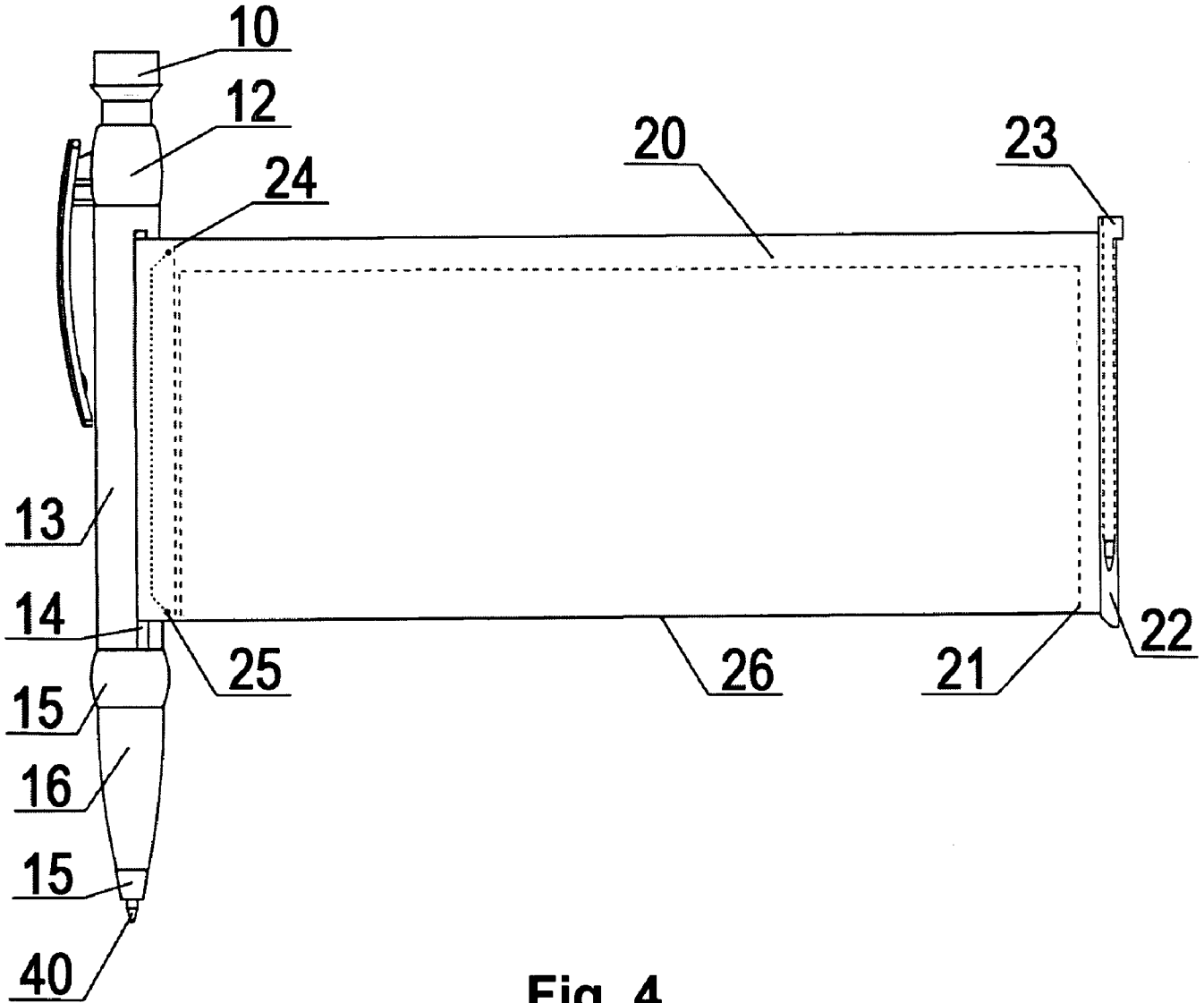
FIG. 4 is an explanation view showing how the stopping mechanism of FIG. 1 works.

As mentioned above, in the prior art, once the map is pulled out, the spring 31 will automatically and continuously draw it back. This is a very inconvenient feature when the user should use both of his hands to do the marking. Therefore, in this embodiment, the shortcoming is now obviated by the newly invented stopping mechanism 24, 25 in FIG. 4. FIG. 4 is an explanation view for showing how the stopping mechanism works. In FIG. 4 (also in FIG. 1), on a rigid plastic sheet 24 glued to the underside of the map 20, there is a kiss-cut line 25 for forming a flap. When the flap is pushed up in a cocked position, the draw-back of the pulled out map will be blocked.

Figure 1B:
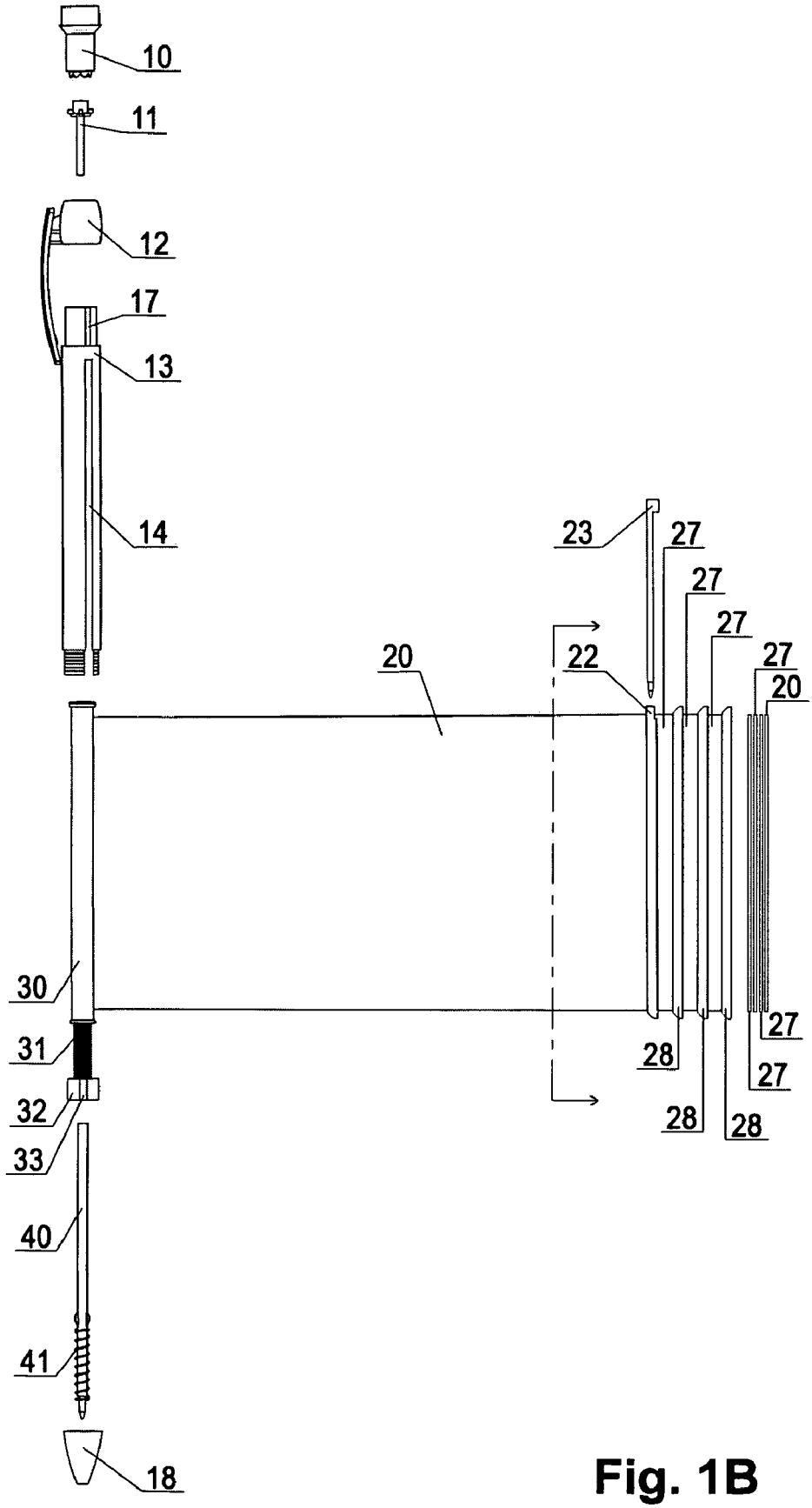
FIG. 1B is an exploded view of a second embodiment showing components used except for the stopping mechanism.
Figure 2B:
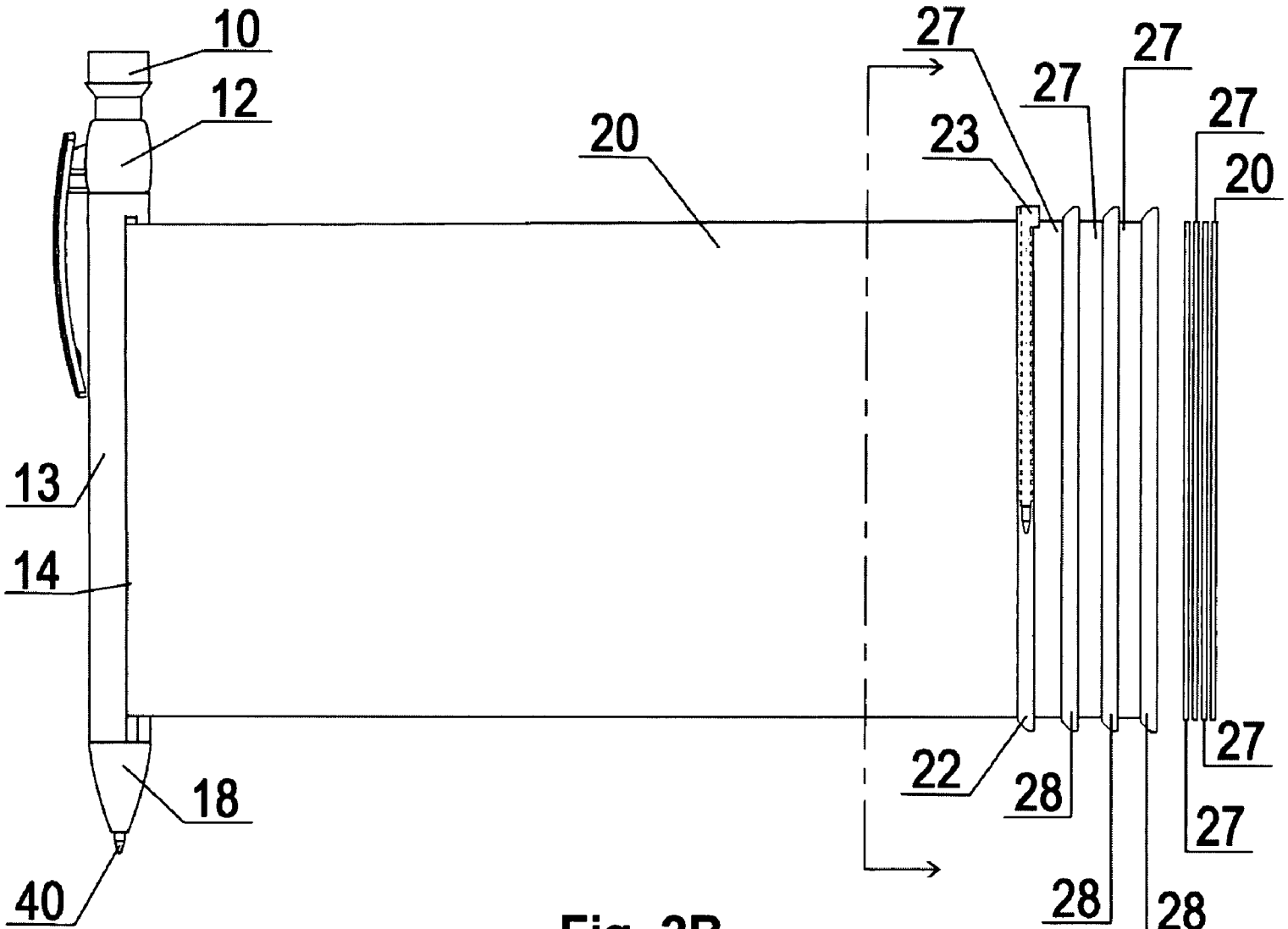
FIG. 2B is a view showing the multi-sheet map of the second embodiment in a pulled-out configuration.

FIGS. 1B and 2B are drawings showing a second embodiment. In this embodiment, a stack of multiple sheets replaces the folded-up sheet used in the first embodiment. In these drawings, a stack of 4 sheets is shown, while in practice, the number of sheets is not limited. In this embodiment, each sheet has its own outside scroll end 22 or 28. Since this embodiment is equipped with only one additional pen 23, only the outside scroll end 22 has a bigger diameter for containing the pen 23. Other outside scroll ends 28 may have smaller diameters. Though in these two drawings, the sheet connecting the end 22 is still represented with part-number 20, and the other sheets connecting ends 28 are represented with part-number 27. In practice, they can be made of the same material and the same thickness. Of course, using different materials and/or different thicknesses for them are also possible.

In FIG. 5, an alternative stopping component 60 (usually made of plastics or non-magnetic metals for avoiding any magnetic interaction with the mini compass) in the form of a knob is resistantly sliding up and down along a slot in barrel 13. Since the lower inner surface of the stopper 60 is slanted, when the user forces the slant surface into the gap between the inner scroll end 30 and the inner wall of the barrel 13, the inner scroll end 30 will be blocked to any rotation. So the pulled-out map will be kept in its position for marking. Alternatively, the inner part of stopper 60 will lock into the inner scroll end 30 and will block any rotation.

Figure 5B:
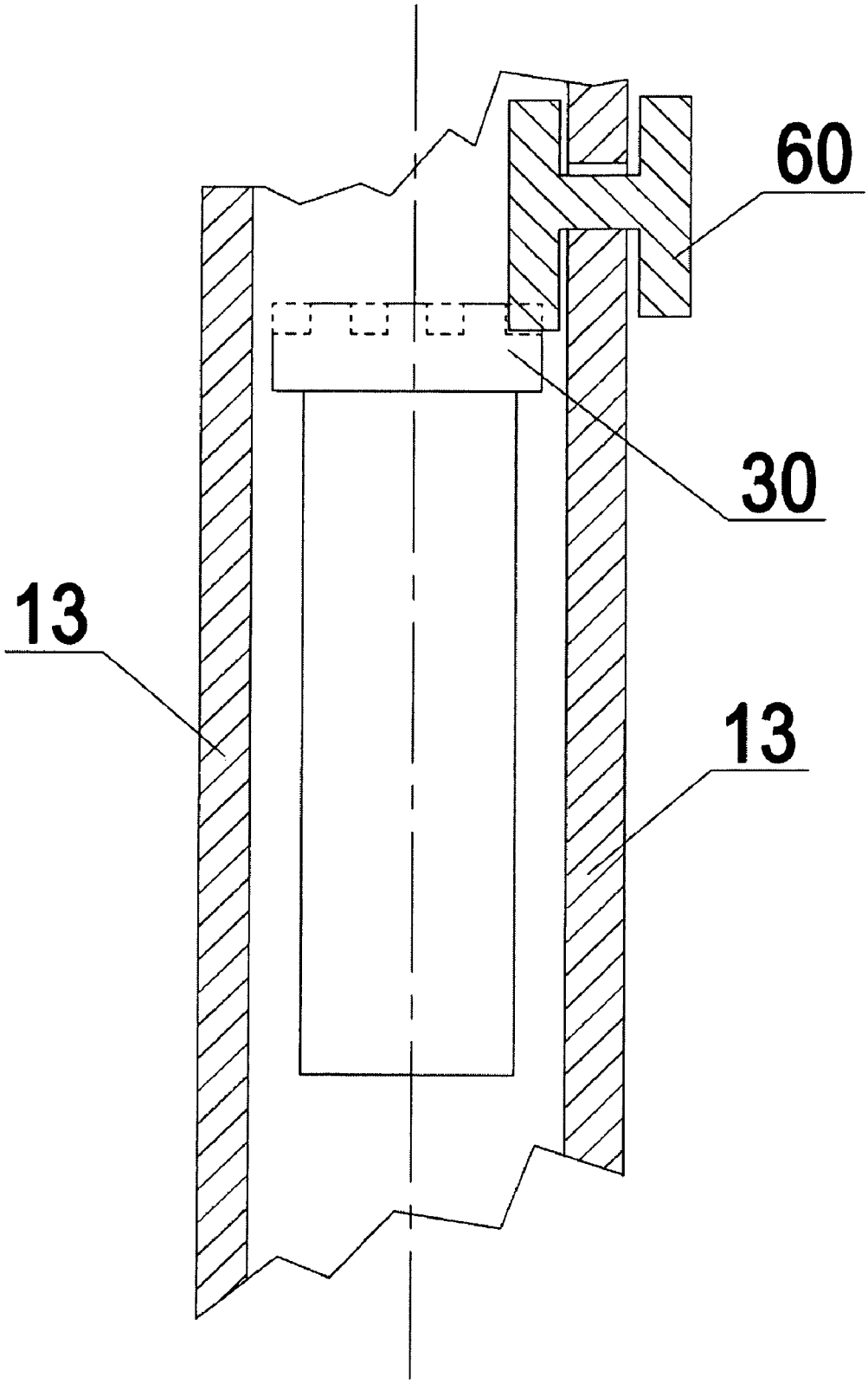
FIG. 5B is a sectional view showing how another optional stopping mechanism works.

In FIG. 5B a similar locking effect can be obtained by the inner part of stopper 60 locking into the turning shaft with a geared top 30.

When the stopper 60 is forced upward, the slant surface will release from the gap and the inner scroll end 30 can rotate freely. A geared locking mechanism based on a pull out, lock, release and recoil system as used in existing products such as roller blinds for windows can be used to replace anyone of the stop means 24, 25 and 60 mentioned above. Stopping component 60 can be customized so the stopper can include a printed word or logo. Alternatively, the stopper can be molded to any shape as to increase its commercial value so the stopper can be molded to branded logo, etc.

Figure 6A:
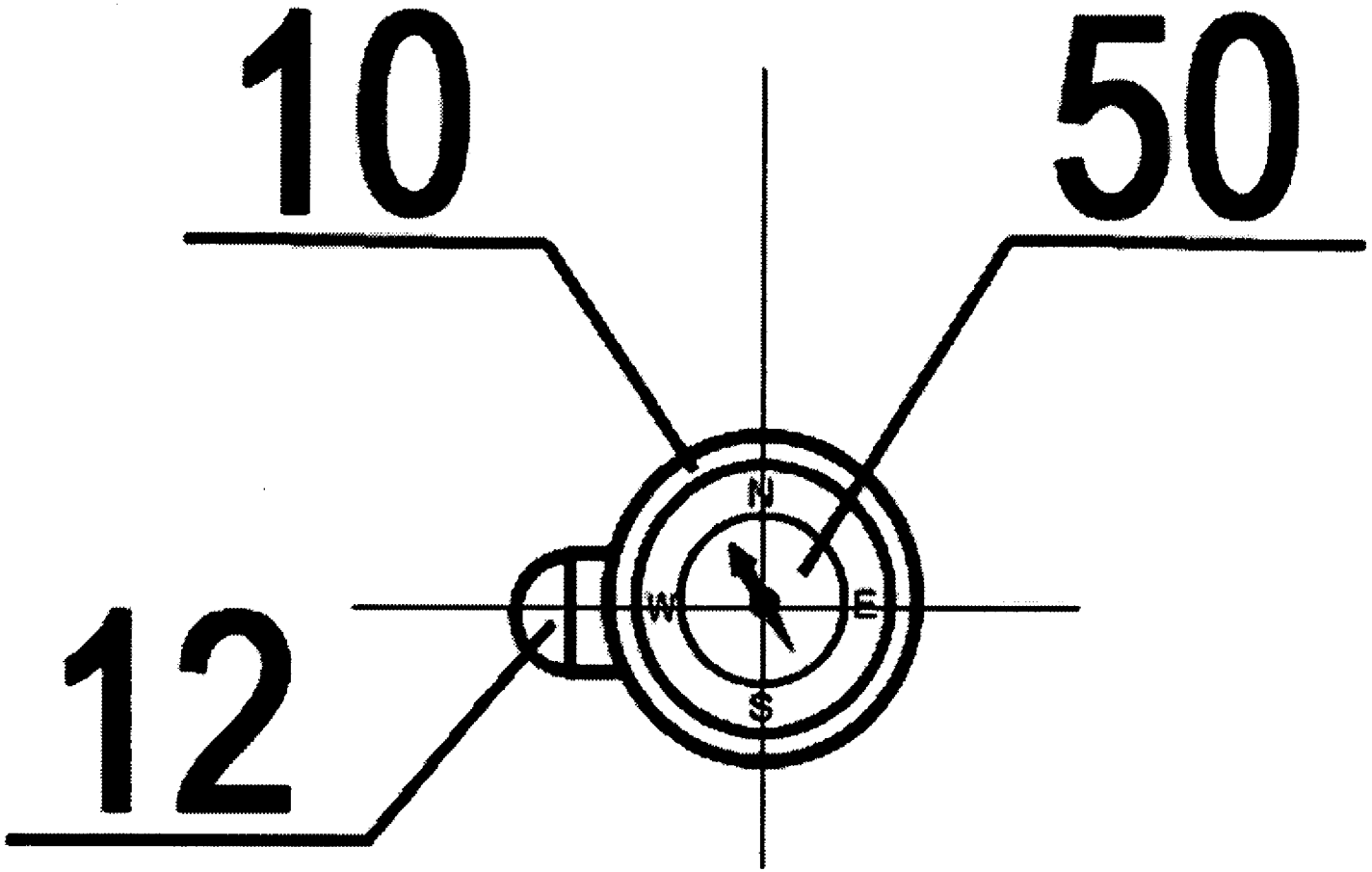
FIGS. 6A and 6B are top and front views showing the compass.
Figure 6B:
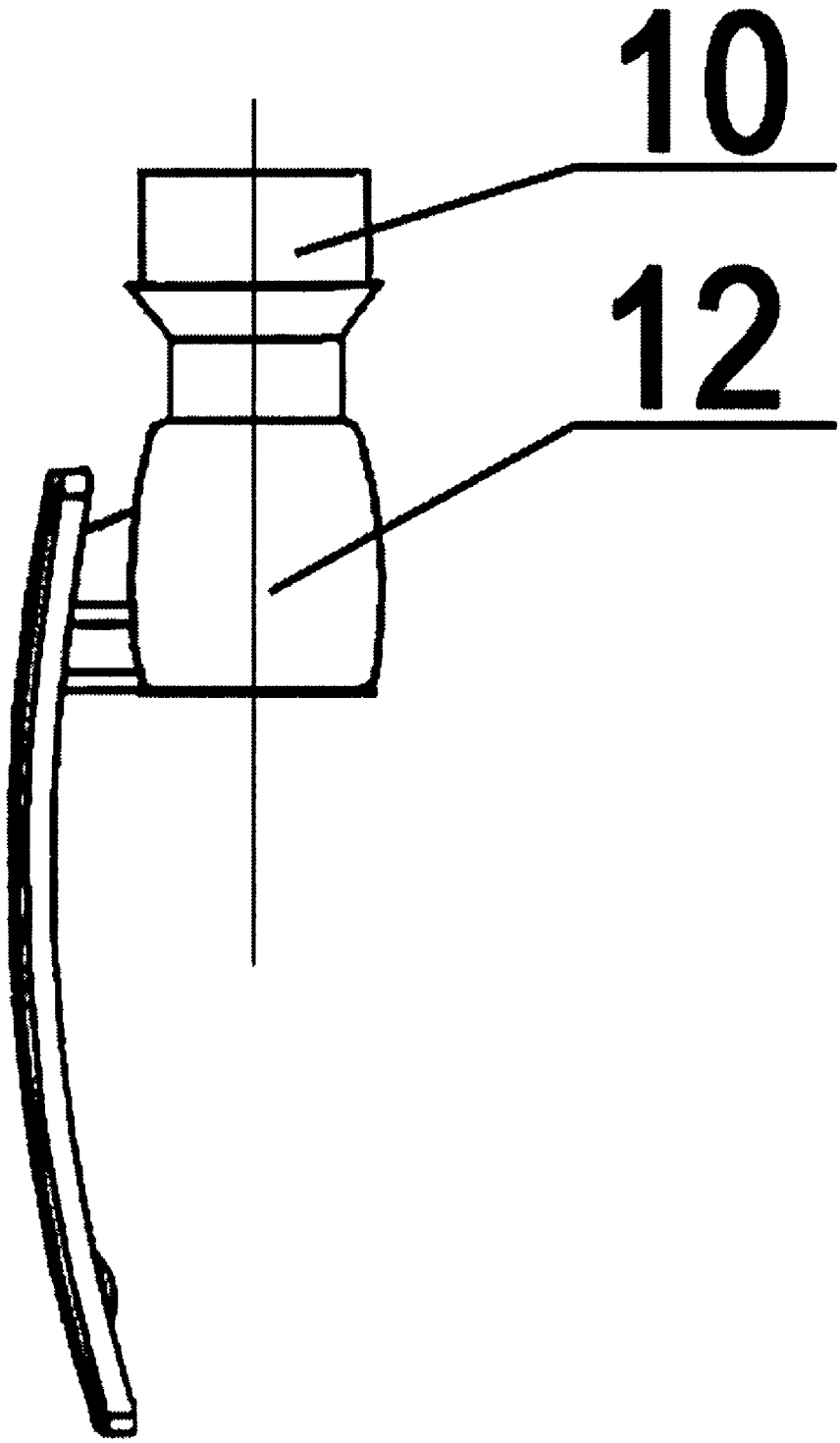

FIGS. 6A and 6B are respectively a top and front view for showing the compass. A compass 50 is installed in the top button 10. The commercial advantages of a multiple sheet message pen that utilizes a locking mechanism are to allow the user to easily read the printed messages without having to continually hold the sheet to stop it from retracting into the barrel body of the pen. This improved map pen is commercially enhanced and useful as a means of advertising and promoting goods and services. Therefore, as an enhanced promotional platform, the compass 50 can be replaced by a printed or molded logo or message to enhance the image of the product or business using the map pen as an advertising platform.

Figure 7:
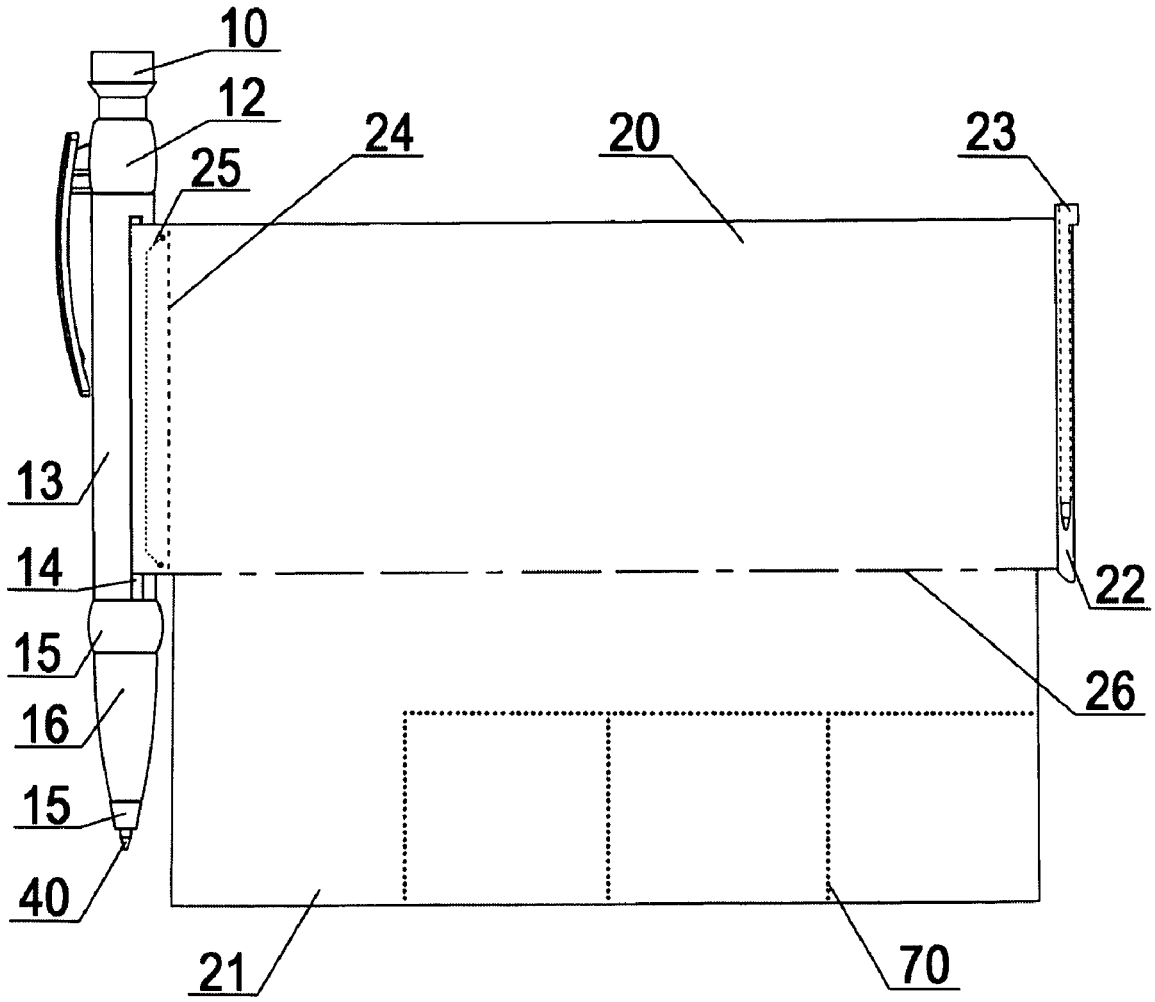
FIG. 7 is a view showing the map of the first embodiment in a pulled-out and un-folded configuration with additional perforated or half-cut lines for tear-away coupons.
Figure 7B:
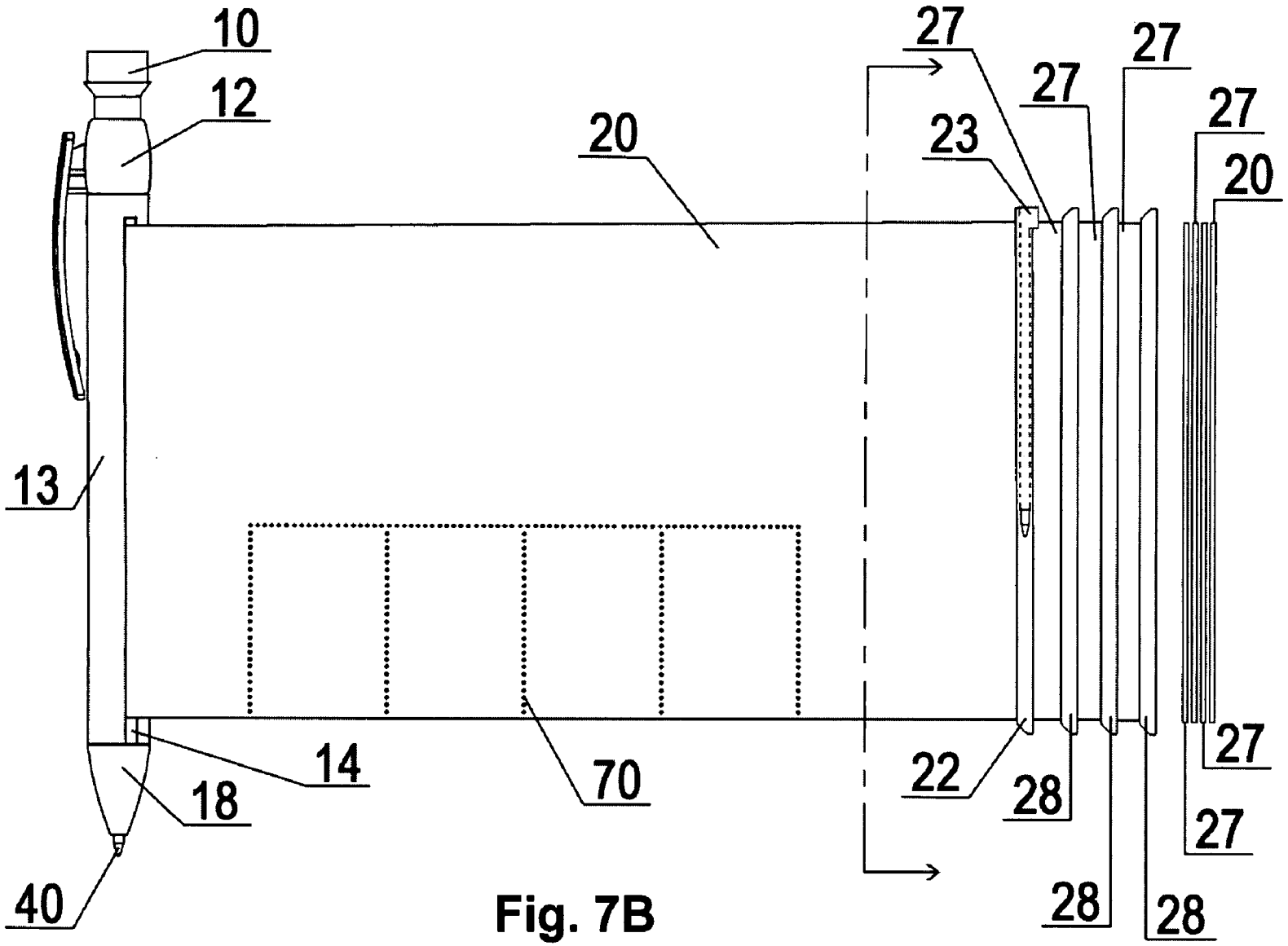
FIG. 7B is a view showing the multi-sheet map of the second embodiment in a pulled-out configuration with additional perforated or half-cut lines for tear-away coupons.

FIG. 7 and FIG. 7B are drawings showing the outside views of the map pen of this first and second embodiment when the map is pulled out and has had perforated or half-cut lines 70 applied to the message sheets 20, 21 and 27 so that tear-away coupons can be used in exchange for advertised goods and services.

Figure 8:
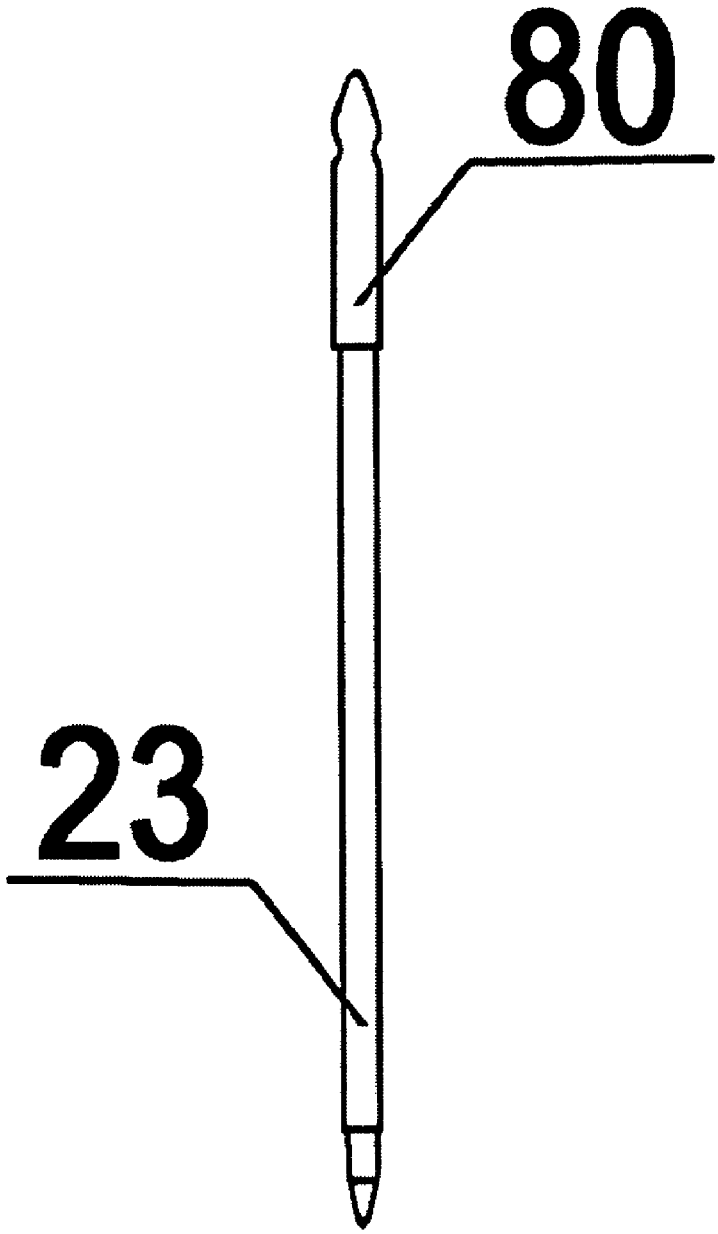
FIG. 8 is a front view showing the additional pen with molded touch-screen pointer top.

FIG. 8 is a front view showing the additional pen 23. A molded end 80 is installed on the top of additional pen 23 for use as a pointer and stylus on a touch-screen personal computer hardware and media.

Figure 9:
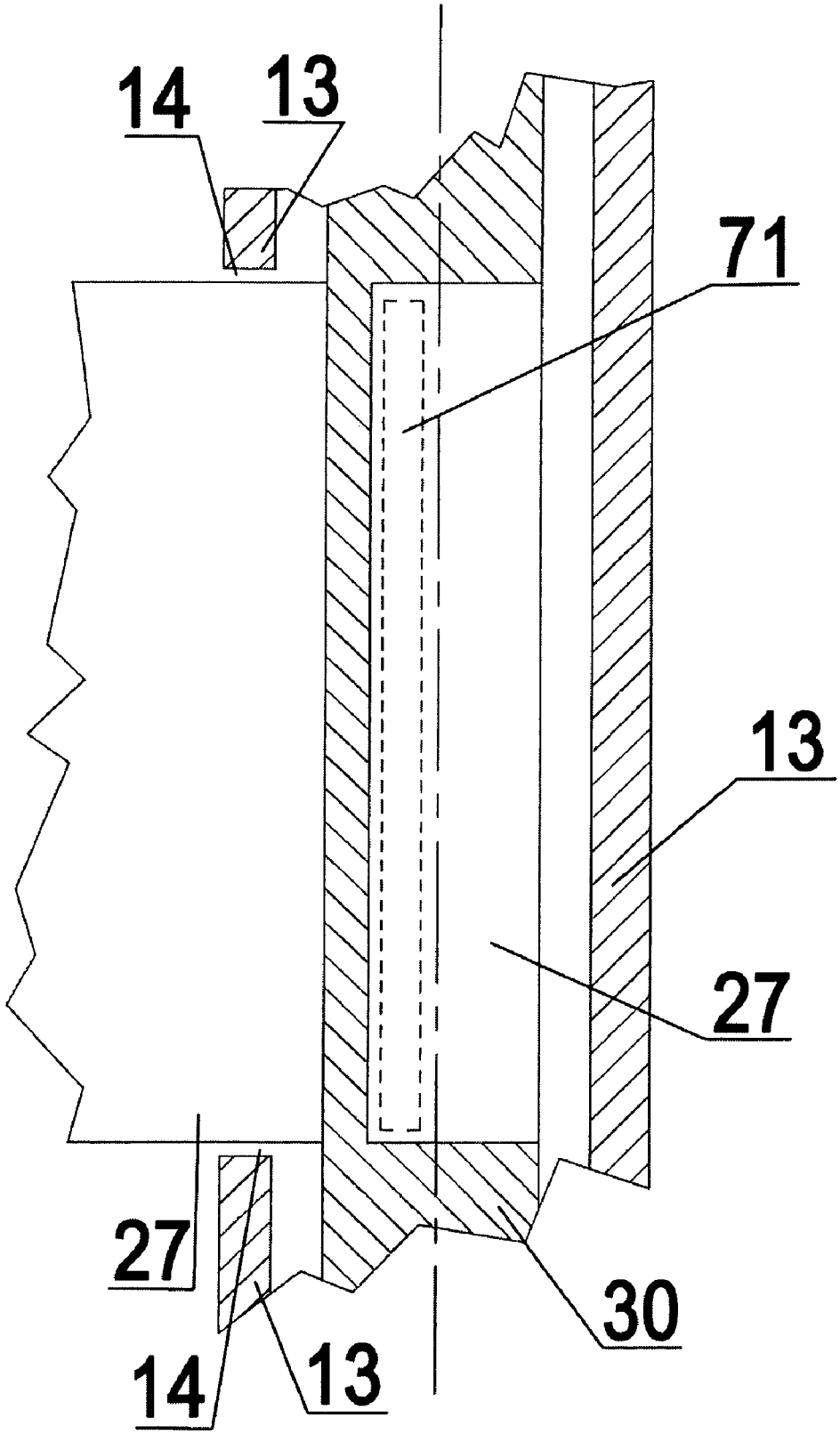
FIG. 9 is a sectional view showing how to eliminate over drawing out the printed sheet or sheets from the slit of the barrel.
Figure 9B:
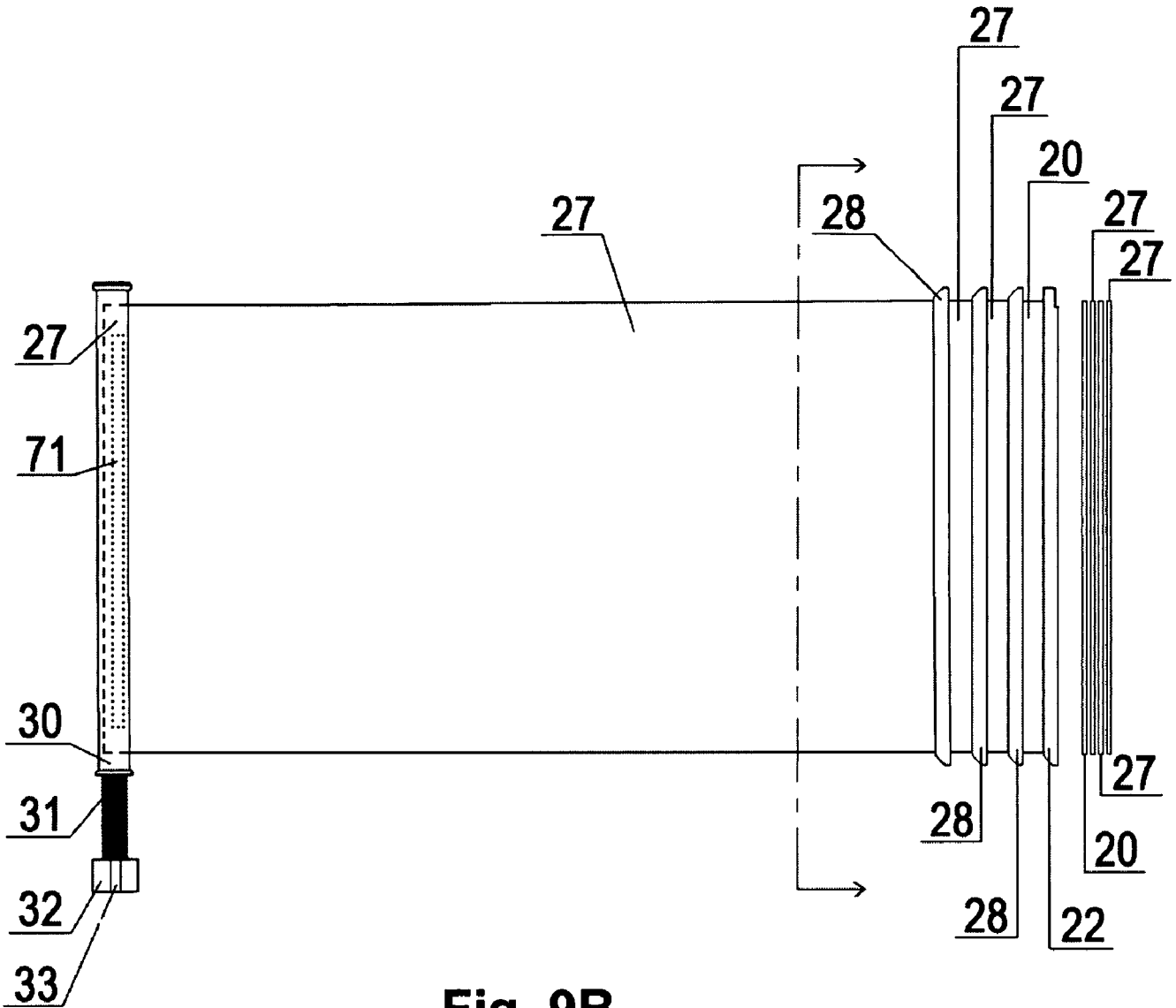
FIG. 9B is an explanation view of the second embodiment showing how to eliminate over drawing out the printed sheet or sheets from the slit of the barrel.

FIG. 9 and FIG. 9B are drawings showing a further feature of the elimination of over drawing out the printed sheet 20 or sheets 27 from the slit 14 of the barrel 13. This prior inconvenience is now prevented by attaching a strong double sided adhesive tape 71 to the last sheet 20 or 27 that has contact with the inner scroll end 30. Now, when the user pulls out the sheets 20 or 27, the process is arrested at a chosen point by the sheet 20 or 27 being securely attached to the inner scroll end 30.

Figure 10A:
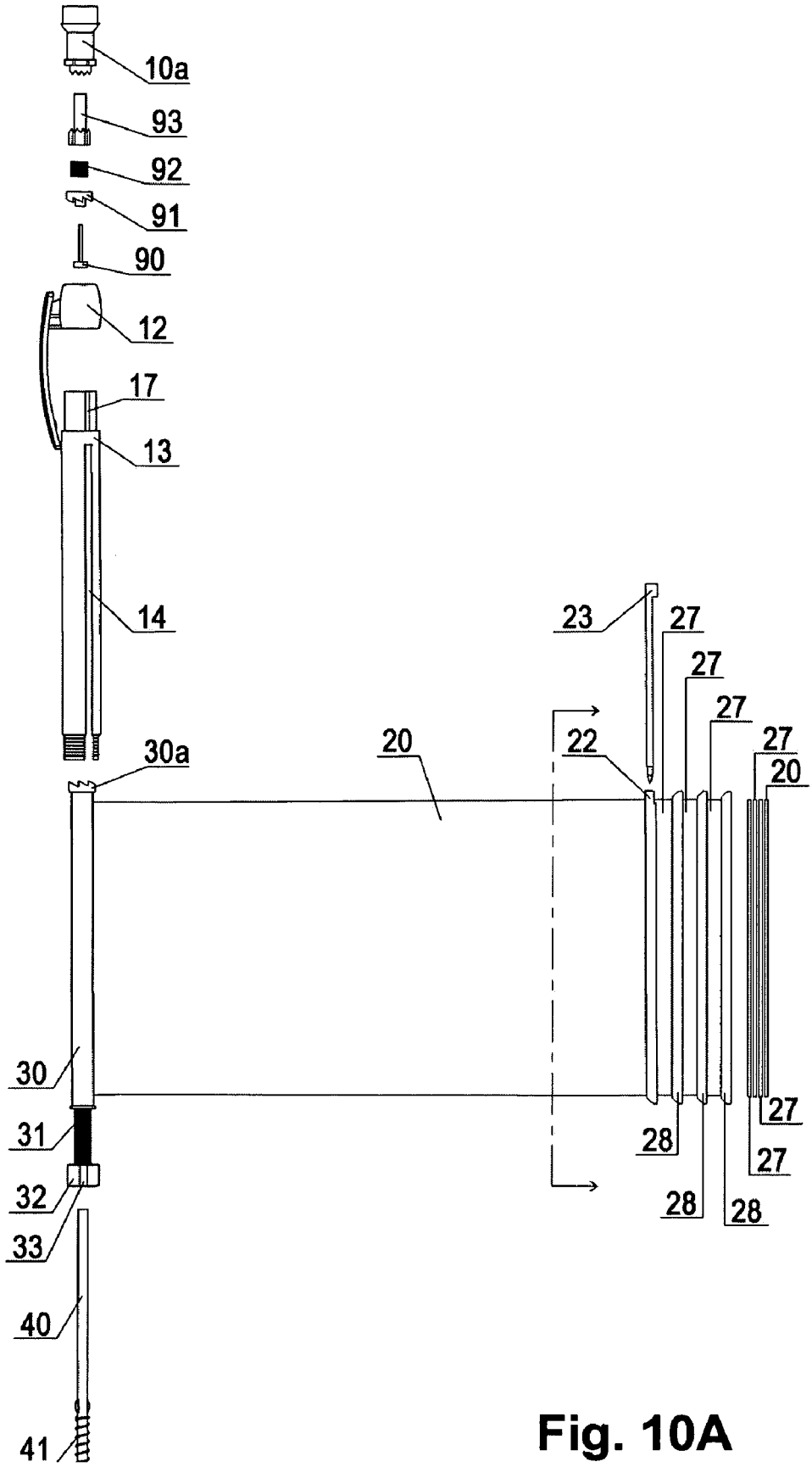
FIG. 10A is an exploded view of the second embodiment of this invention showing all components including the alternative stopping mechanism which is activated by the top button of a conventional ball pen, which includes a plunger with a cup top and a geared locking base.
Figure 10B:
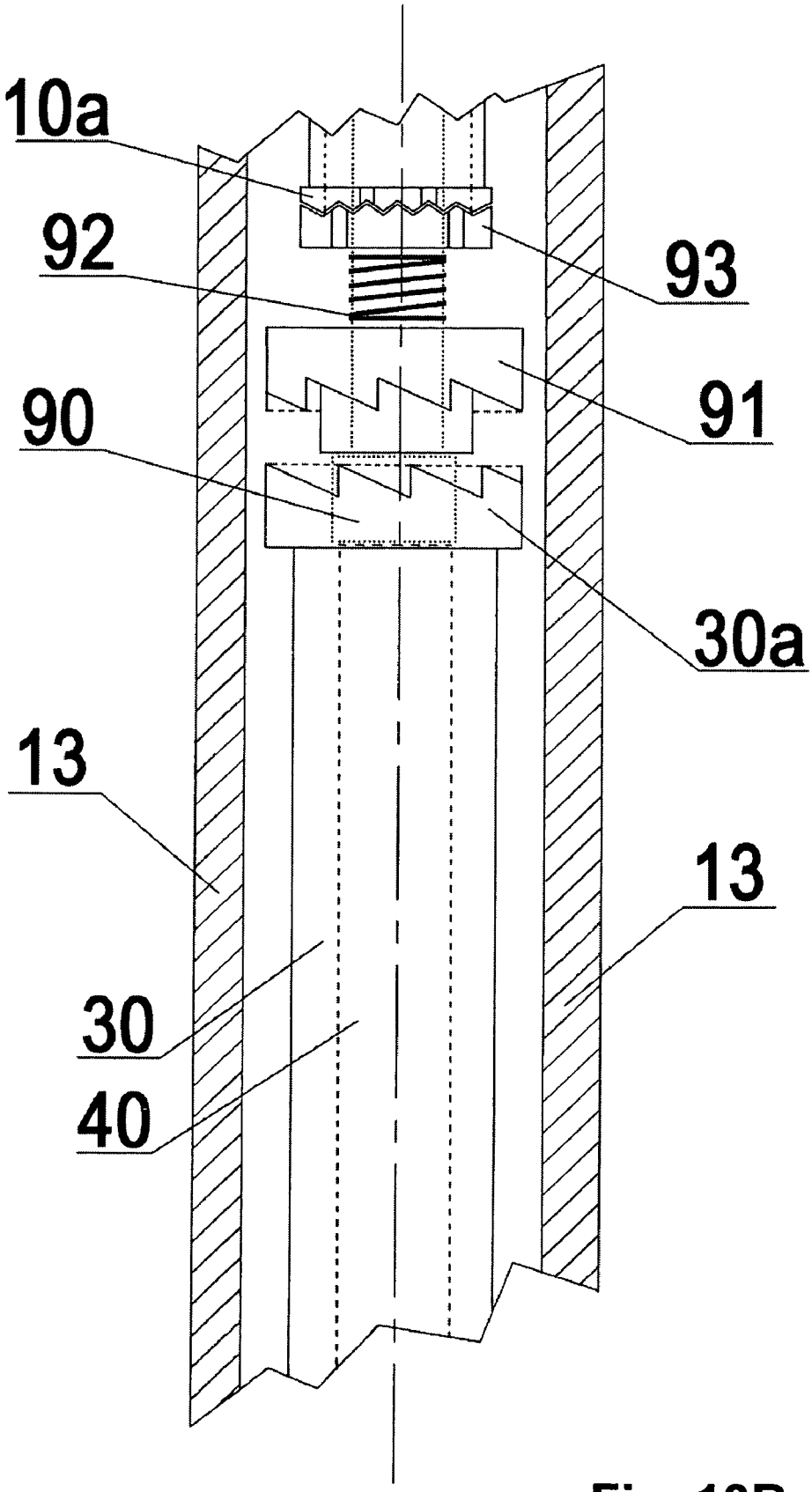
FIG. 10B is a sectional view showing how the alternative stopping mechanism which is activated by the top button of a conventional ball pen, which includes a plunger with a cup top and a geared locking base works when in an open/unlocked position.
Figure 10C:
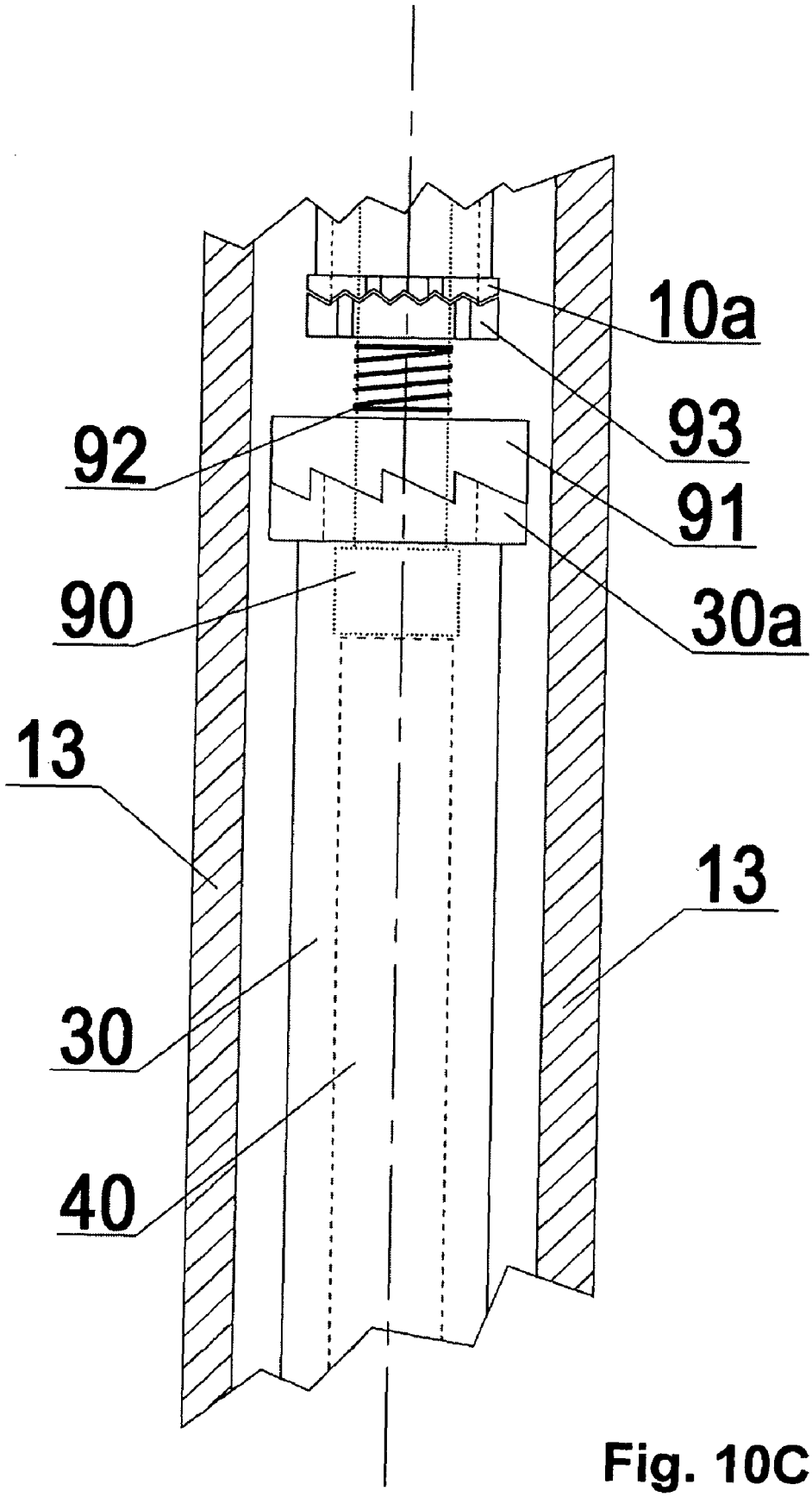
FIG. 10C is a sectional view showing how the alternative stopping mechanism which is activated by the top button of a conventional ball pen, which includes a plunger with a cup top and a geared locking base works when in a closed/locked position.

In FIG. 10A, FIG. 10B and FIG. 10C, an alternative stopping mechanism is activated by the top button of a conventional ball pen, which includes a plunger with a cup top and a locking geared base 10*a*. The alternative mechanism works by using the conventional retractable ball pen action that exposes the refill 40 by means of pressing and depressing a spring 41 that is activated by the top button of a conventional ball pen, which includes a plunger with a cup top and a locking geared base 10*a*.

FIG. 10B shows an alternative stopping mechanism which is activated by the top button of a conventional ball pen, which includes a plunger with a cup top and a locking geared base 10*a* when in an open/unlocked position. When the pen is in this unlocked position, the pen refill 40 is retracted inside the outer housing barrel 13 as there no tension from the pen refill spring 41 (not shown). When the stopping mechanism is in an unlocked position, the geared disc 91 and the reciprocal geared top 30*a* of the inner scroll end in the form of a centre tube 30 are in a decoupled position allowing the maps/sheets 20/27 (not shown) to be pulled out and retracted unhindered.

FIG. 10C shows an alternative stopping mechanism activated by the top button of a conventional ball pen, which includes a plunger with a cup top and a locking geared base 10*a* when in a closed/locked position. When the pen is in this locked position, the pen refill 40 is exposed from the outer housing barrel 13 for writing purposes. When the stopping mechanism is in a locked position, the geared disc 91 and the reciprocal geared top 30*a* of the inner scroll end in the form of a centre tube 30 are in a coupled/held position blocking any rotation thus hindering the maps/sheets 20/27 (not shown) to be pulled out and retracted.

The alternative stopping mechanism shown in FIG. 10A, FIG. 10B and FIG. 10C incorporates the spring mechanism of a conventional retractable ball pen with the addition of newly invented elements 90, 91, 92 and 30*a*. These newly invented elements are used in a combined system to lock or unlock the inner scroll end 30 and maps/sheets 20/27 (not shown) when exposing or retracting the pen refill 40 for writing purposes by means of depressing the top button of a conventional ball pen, which includes a plunger with a cup top and a locking geared base 10*a*.

The mechanics of this alternative locking mechanism is formed by placing a spring 92 above the geared disc 91 and is held together by a positioning pin 90 that is supported by the pen refill 40. The pen refill 40 that supports the positioning pin 90 is housed inside the inner scroll end 30. When the system is unlocked, the positioning pin is retracted inside the inner scroll end 30. When the system is locked, the positioning pin is exposed from the inner scroll end 30 thus coupling/joining geared disc 91 and reciprocal geared top of inner scroll end 30*a* thus blocking any rotation.

Above the spring 92 is the lower plunger locking gear 93 which is used in prior art devices to couple with top button of a conventional ball pen, which includes a plunger with cup top and locking geared base 10*a* to expose and retract the pen refill 40 for writing purposes. Though this invention had been described with embodiments mentioned above, anyone skilled in the art can modify it easily and without deviating the scope of this invention. For example, the ball pens 23 and 40 can be replaced by any kind of pen such as, gel-pen, pencil, etc. The map can be triple folded. The compass can be installed in any portion of the stem, of the cap, etc.

The invention claimed is:

1. An improved map pen characterized in that it comprises:
- a retractable pen assembly having a barrel with a slit;
- a scroll having an inner end and retractable within said barrel and extendable through said slit and having a tube-shaped outside scroll end, said scroll comprising:
  - a folded up map or a stack of sheets;
  - an additional pen installed in the tube-shaped outside scroll end; and
- a stopper mechanism stopping the scroll from retracting into said barrel.

2. An improved map pen as in claim 1, wherein said folded up map is made of high-strength plastic film.

3. An improved map pen as in claim 1, wherein said folded up map can be triple folded.

4. An improved map pen as in claim 1, wherein said stopper mechanism comprises a knob made of plastics.

5. An improved map pen as in claim 1, wherein said stopper mechanism comprises a knob made of non-magnetic metals.

6. An improved map pen as in claim 1, wherein said stop mechanism comprises an inner part of stopper and a matched geared top portion which cooperate to stop retraction of said map or sheets.

7. An improved map pen as in claim 1, wherein a compass is installed in a top portion of a top button of the pen.

8. An improved map pen as in claim 1, wherein said pen assembly comprises a pen chosen from the group consisting of a ball pen and a gel-pen.

9. An improved map pen as in claim 1, wherein said additional pen has a molded end configured for use as a PDA personal computer device touchscreen pointer and stylus.

10. An improved map pen as in claim 1, wherein said scroll has perforated or half-cut lines to define tear-away coupons.

11. An improved map pen as in claim 1, wherein strong doublesided adhesive tape is attached to a last sheet portion that has contact with the inner scroll end to eliminate over drawing of the scroll from the slit of the barrel.

12. An improved map pen as in claim 1, wherein said stopping mechanism comprises a spring, a positioning pin, a geared disc and a reciprocal geared top of the inner scroll end to block any rotation of the inner scroll end when activated by depressing a top button which includes a plunger with a cup top and locking geared base to expose a pen refill thus locking or unlocking the scroll.

13. An improved map pen as in claim 1 comprising a flap attached to the scroll.

14. An improved map writing instrument characterized in that it comprises:
- a retractable pencil assembly having a barrel with a slit;
- a scroll having an inner end and retractable within said barrel and extendable through said slit and having a tube-shaped outside scroll end, said scroll comprising:
  - a folded up map or a stack of sheets;
  - an additional writing instrument installed in the tube-shaped outside scroll end; and
- a stopper mechanism stopping the scroll from retracting into said barrel.

15. An improved map writing instrument of claim 14 wherein the additional writing instrument is selected from the group consisting of a ball pen, a gel-pen and a pencil.

16. An improved map pen characterized in that it comprises:
- a retractable pen assembly having a barrel with a slit;
- a scroll having an inner end and retractable within said barrel and extendable through said slit and having a tube-shaped outside scroll end, said scroll comprising:
  - a folded up map or a stack of sheets;
  - an additional pencil installed in the tube-shaped outside scroll end;

and
- a stopper mechanism stopping the scroll from retracting into said barrel.

* * * * *